US008448816B2

(12) United States Patent
Gordon

(10) Patent No.: US 8,448,816 B2
(45) Date of Patent: May 28, 2013

(54) WIPES

(76) Inventor: Michael John Gordon, Farnham Royal (GB)

( * ) Notice: Subject to any disclaimer, the term of this patent is extended or adjusted under 35 U.S.C. 154(b) by 219 days.

(21) Appl. No.: 12/741,944

(22) PCT Filed: Nov. 6, 2008

(86) PCT No.: PCT/GB2008/051036

§ 371 (c)(1),
(2), (4) Date: May 7, 2010

(87) PCT Pub. No.: WO2009/060237

PCT Pub. Date: May 14, 2009

(65) Prior Publication Data

US 2010/0264159 A1 Oct. 21, 2010

(30) Foreign Application Priority Data

Nov. 7, 2007 (GB) ..... 0721805.0
May 15, 2008 (GB) ..... 0808813.0
May 20, 2008 (GB) ..... 0809089.6

(51) Int. Cl.
*A47K 10/38* (2006.01)

(52) U.S. Cl.
USPC ..... 221/32; 221/45; 221/63; 428/43; 428/906

(58) Field of Classification Search
USPC ..... 221/32, 33, 47, 63, 45; 428/43, 906
See application file for complete search history.

(56) References Cited

U.S. PATENT DOCUMENTS 4,627,117 A * 12/1986 Morishita ..... 4/244.2
5,131,903 A * 7/1992 Levine et al. ..... 493/464
6,029,921 A 2/2000 Johnson
6,364,101 B1 * 4/2002 Schultz ..... 206/210

(Continued)

FOREIGN PATENT DOCUMENTS

DE 27 06 234 A1 8/1978
DE 8715128 U1 * 1/1998

(Continued)

OTHER PUBLICATIONS

International Search Report, International Application No. PCT/GB2008/051036, Mar. 2, 2009.

*Primary Examiner* — Patrick Mackey
(74) *Attorney, Agent, or Firm* — Fay Sharpe LLP

(57) ABSTRACT

The invention relates to a container haying a nozzle or opening (11), containing a roll of wipes, for dispensation in a direction parallel to the axis of the roll through the nozzle or opening of the container. The wipes (1) are formed from a continuous length of material (2) with parallel side edges (2A,2B) having a leading end (3A) and a 'trailing end (3B). The rupturable lines (4) extend from a point (5A) on one first side edge (2A) to a point (5B) on the second side edge (2B). Each rupturable line is more easily ruptured adjacent the second side edge than the first side edge. The wipes are arranged such that said point on the first side edge of the rupturable line emerges from the nozzle or opening before said point on the second side edge.

17 Claims, 5 Drawing Sheets

U.S. PATENT DOCUMENTS

| | | | | |
|---|---|---|---|---|
| 6,447,864 | B2 * | 9/2002 | Johnson et al. | 428/43 |
| 6,536,624 | B2 * | 3/2003 | Johnson et al. | 221/45 |
| 6,899,250 | B2 * | 5/2005 | FitzSimons et al. | 221/45 |
| 7,163,124 | B2 * | 1/2007 | Bushman et al. | 221/135 |
| 7,380,687 | B2 * | 6/2008 | FitzSimons et al. | 221/45 |
| 2002/0074375 | A1 | 6/2002 | Irwin | |
| 2002/0155246 | A1 | 10/2002 | Johnson et al. | |

FOREIGN PATENT DOCUMENTS

| | | | |
|---|---|---|---|
| DE | 20314147 | U1 * | 1/2004 |
| DE | 20314147 | | 12/2004 |
| FR | 2623178 | A3 | 5/1989 |
| GB | 2 441 323 | A | 3/2008 |
| GB | 2 441 397 | A | 3/2008 |
| WO | WO 01/03563 | A1 | 1/2001 |

* cited by examiner

WIPES

CROSS-REFERENCE TO RELATED APPLICATIONS

This application is a national stage entry of international application number PCT/GB2008/051036, having international filing date of Nov. 6, 2008, which was published in English, and which claims priority to Great Britain Patent Application Nos. GB0721805.0, filed Nov. 7, 2007, GB0808813.0, filed May 15, 2008, and GB0809089.6, filed May 20, 2008, the entireties of which are hereby incorporated by reference as if fully set forth herein.

The present invention relates to wipes.

Wipes are usually formed from a continuous length of impregnated non-woven fabric with parallel side edges, and lines of rupturable perforations equally spaced along the length of the fabric with each line normal to and spanning the width of fabric between the side edges. Each wipe is thus formed between lines of perforations.

Such wipes are often packaged in a tub and dispensed through a tub aperture. As a wipe is drawn through the aperture the perforations rupture so separating an individual wipe from the rest of the length of wipes, and the leading edge of the next wipe is left projecting through the aperture to be pulled out of the tub when the next wipe is to be used.

A problem with such wipes is that the perforations between wipes can rupture before the leading edge of the next wipe is left projecting through the aperture, so a user cannot withdraw another wipe without opening the tub and feeding the next wipe through the aperture. Alternatively the perforations rupture just as the leading edge of the next wipe projects through the aperture, but there is insufficient length of the leading edge to be grasped to withdraw the next wipe.

An example of an improved method for ensuring that a tail or 'presentment' is made available for the next user is described in US 20020074375A1. The wipes feature a perforated region along its length with 'cut' regions on one or both sides of the perforated region. The perforations in the perforated region are uniform along their length and require the same strength to rupture them at any point along their length. As the wipe is drawn to the opening of the container, these cuts cause areas of the wipe to bend backwards and catch with the opening. These distorted areas necessarily become catch flaps. This causes enough tension in the perforated region which is now outside the opening of the container to break the dispensed individual sheet free. The wipes emerge from a slit-like dispensing opening, the mechanism for separating the wipes being the action of catch flaps engaging with the slit like opening. This method applies to a pop-up wipe dispensing system with wipes being dispensed from the outside of the roll of wipes contained within the dispenser.

In the case of a tub of wipes, the continuous length of material emerges from the centre of the web in a generally twisted, tube-like format which will not of necessity allow for catch flaps to be formed from cut sections because the cut sections which formed the catch flaps as detailed in US 20020074375A1, become part of the twisted tube-like arrangement. A different mechanism is therefore required to encourage wipes dispensed from a tub to separate into individual sheets.

US2002155246 shows wipes with perforations perpendicular to the wipe side edges, but the perforations are as easy on one side edge to rupture as on another, although a given line of perforations may have a variable degree of rupturability across its length. Also it does not show a rupturable line which is progressively more difficult to rupture along its length from one second side edge to another side edge.

The invention seeks to provide a solution to this problem.

According to the present invention there is provided a container having a nozzle or opening, containing a roll of wipes formed from a continuous length of material with parallel side edges having a leading end and a trailing end, for dispensation in a direction parallel to the axis of the roll through a nozzle or opening of the container, the wipes having ruputurable lines spaced along the length of material separating each wipe, said rupturable lines extending from a point on one first side edge to a point on the other second side edge, and each rupturable line being more easily ruptured adjacent the second side edge than the first side edge, the wipes being arranged such that said point on one first side edge of the rupturable line emerges from the nozzle or opening before said point on the other second side edge.

The invention also extends to a container of wipes as defined above adapted to be dispensed through a container aperture.

The container of wipes may be of the type described in patent application nos GB 0710596.8 and GB0617067.4, the contents of which are hereby incorporated herein.

An embodiment of the invention will now be described with reference to the accompanying drawings in which.

Figure 1:
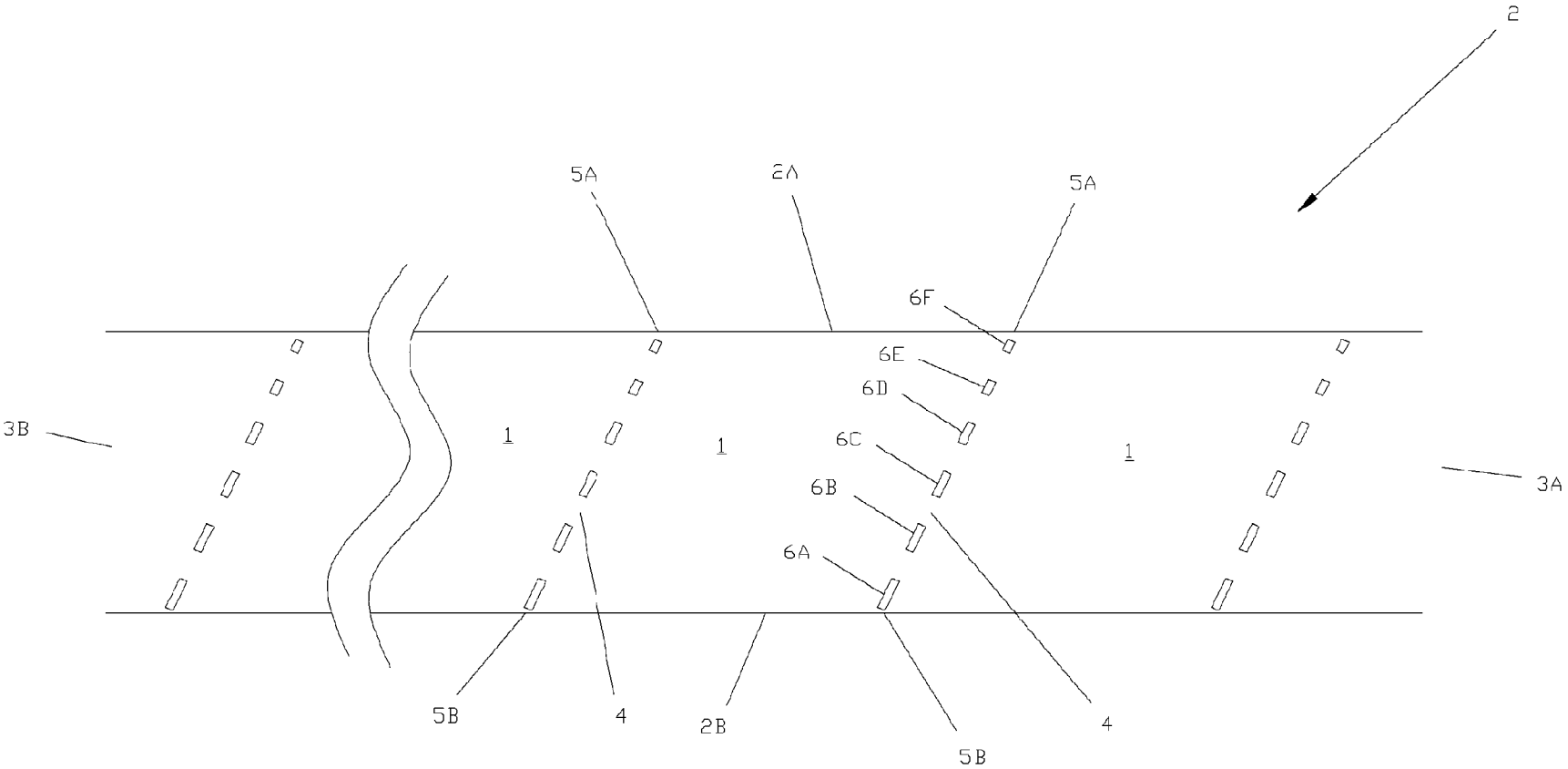
FIG. 1 shows a plan view of a first embodiment of wipes.

Referring to FIG. 1 there are shown wipes 1 formed from a continuous length of material 2 with parallel first and second side edges 2A,2B having a leading end 3A and a trailing end 3B.

Ruputurable straight lines 4 in material 2 are spaced along the length of material separating each wipe 1. Each rupturable line extends from a point 5A on first side 2A edge to a point 5B on the other second side edge 2B further towards the trailing end.

As shown, each line 4 is formed from slots 6A,6B,6C,6D, 6E,6F which progressively reduce in length so that slot 6A is the longest and slot 6F the shortest. Each line 4 is thus more easily ruptured adjacent the second side edge 2B than the first side edge 2A, and each line 4 is progressively more difficult to rupture along its length from the second side edge to the first side edge.

Figure 2:
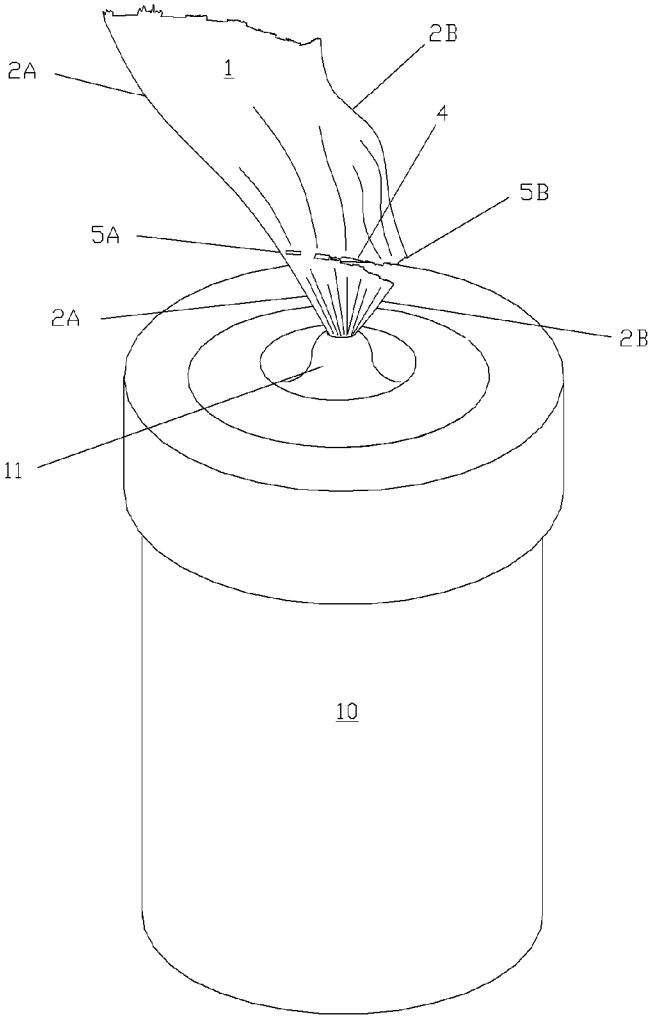
FIG. 2 shows a wipe separating from the leading edge of a wipe emerging through a tub aperture.

Referring now to FIG. 2, there is shown a tub 10 housing and dispensing wipes 1 of the type shown in FIG. 1 through a nozzle or aperture 11.

As the first wipe 1 is withdrawn from the nozzle, it pulls with it the next second wipe until the point 5B on second edge 2B emerges out of the nozzle. The friction of the nozzle is not great enough such that the rupturable line 4 starts to rupture adjacent point 5A, but is great enough to cause the onset of ruptures at point 5B. Once started, the rupturable line continues to rupture back towards the first side edge. So the rupturing process does not start until trailing edge 5B has reached the nozzle, leading edge 5A already being outside the container. Whilst the rupturing process is taking place, the ruptured areas of the wipe, having become separated from and now creating a gap with the main body of the material as shown in FIG. 2, will of necessity fall behind and further trail the non ruptured areas. So the angularity of rupturable line together with the delay between the rupture of edge 5B and edge 5A ensuring that when the first wipe has separated from the next second wipe, the leading edge of the next wipe to be withdrawn extends fully out of the aperture so it can be gripped easily.

Figure 3:
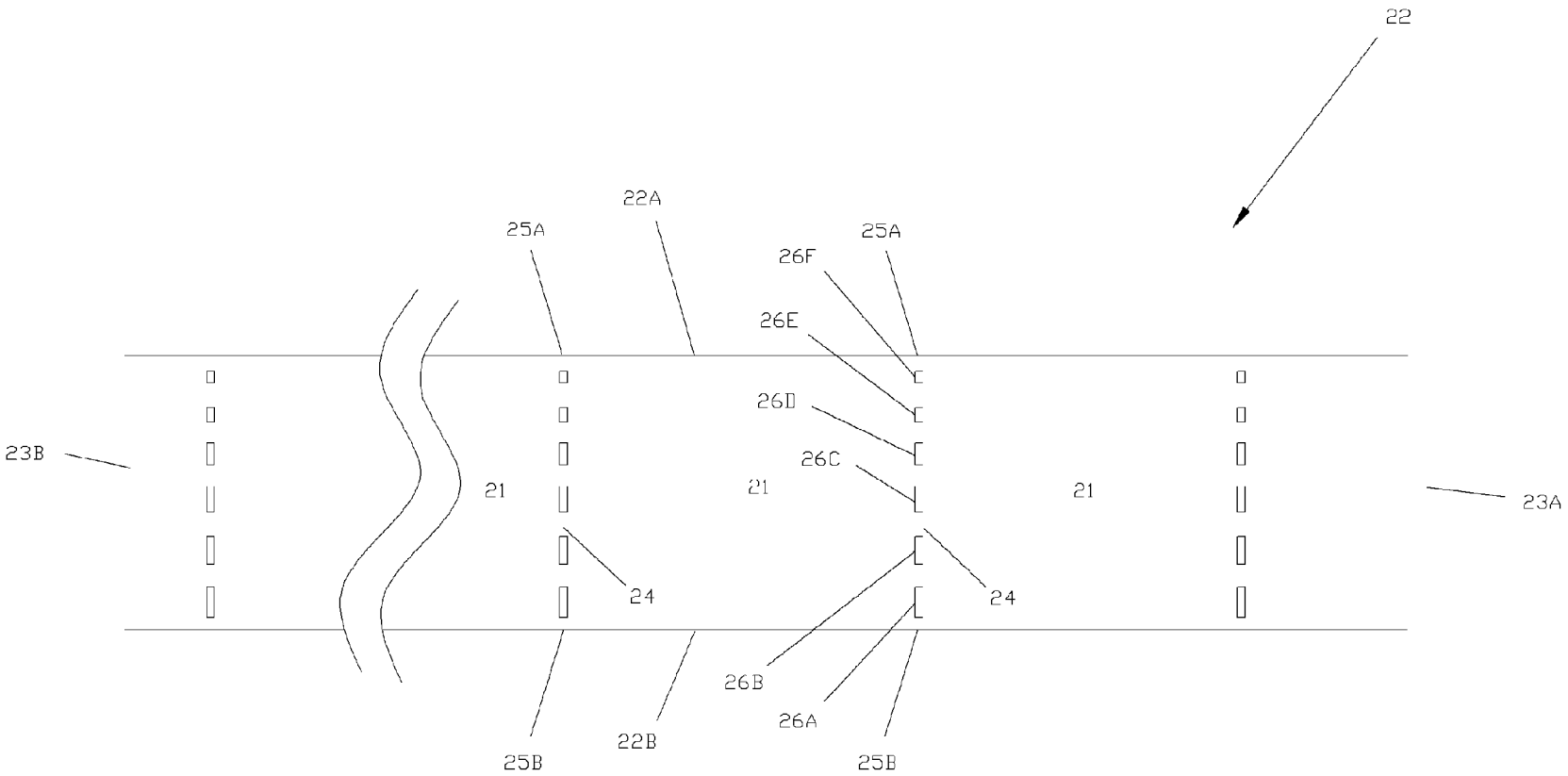
FIG. 3 shows a plan view of a second embodiment of wipes.

Referring to FIG. 3 there are shown wipes 21 formed from a continuous length of material 22 with parallel first and second side edges 22A,22B having a leading end 23A and a trailing end 23B.

Ruputurable straight lines 24 in material 22 are spaced along the length of material separating each wipe 21. Each rupturable line extends from a point 25A on first side 22A edge to a point 25B on the other second side edge 2B, and each rupturable line is at right angles or perpendicular to the side edges.

As shown, each line 24 is formed from slots 26A,26B,26C, 26D,26E,26F which progressively reduce in length so that slot 26A is the longest and slot 26F the shortest. Each line 24 is thus more easily ruptured adjacent the second side edge 22B than the first side edge 22A, and each line 24 is progressively more difficult to rupture along its length from the second side edge to the first side edge.

Figure 4:
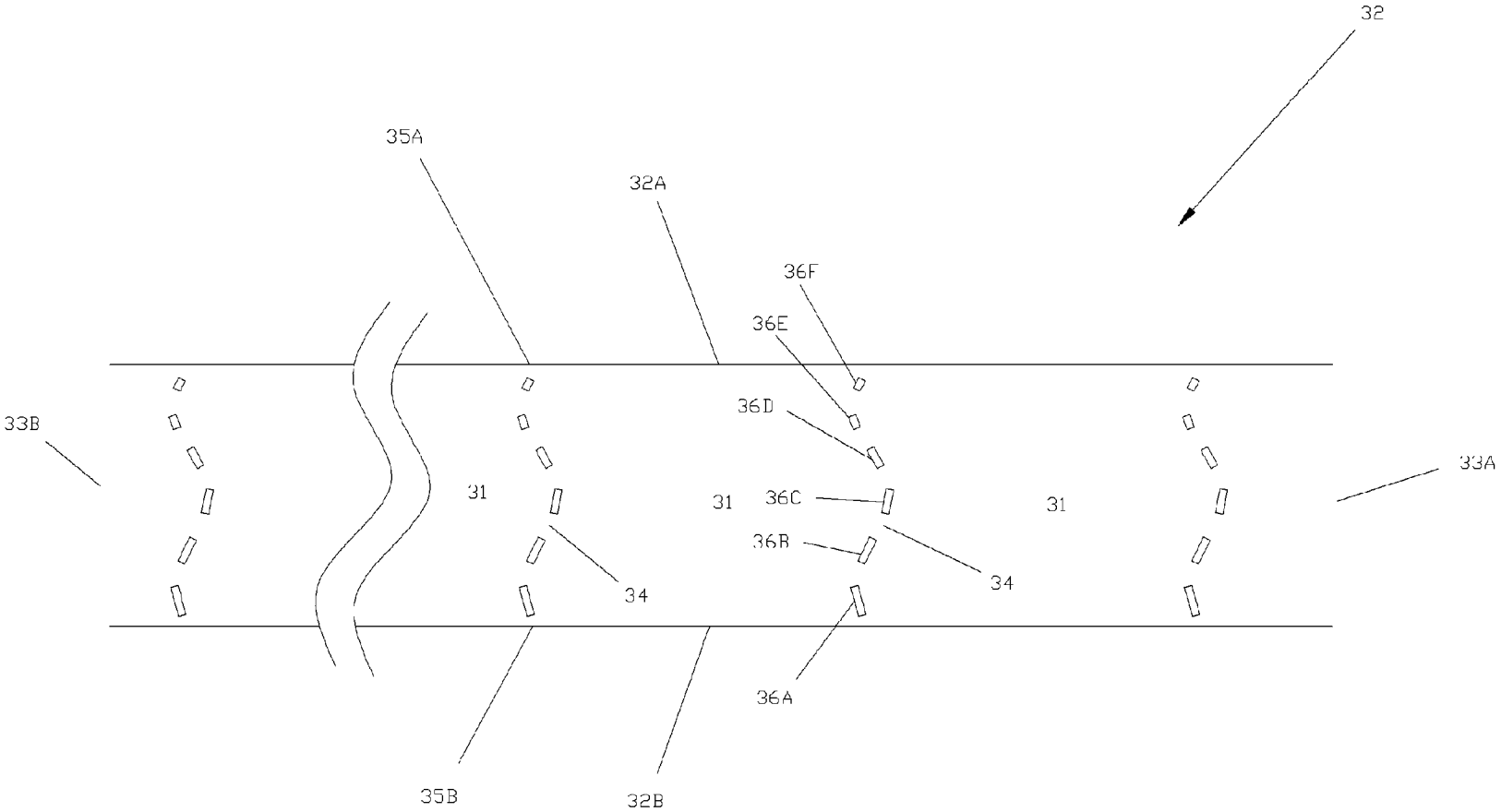
FIG. 4 shows a plan view of a third embodiment of wipes.

Referring to FIG. 4 there are shown wipes 31 formed from a continuous length of material 32 with parallel first and second side edges 32A,32B having a leading end 33A and a trailing end 33B.

Ruputurable wavy lines 34 in material 32 are spaced along the length of material separating each wipe 31. Each rupturable line extends from a point 35A on first side 32A edge to a point 35B on the other second side edge 32B, and each wavy rupturable line is generally at right angles or perpendicular to the side edges.

As shown, each line 34 is formed from slots 36A,36B,36C, 36D,36E,36F which progressively reduce in length so that slot 36A is the longest and slot 36F the shortest. Each line 34 is thus more easily ruptured adjacent the second side edge 32B than the first side edge 32A, and each line 34 is progressively more difficult to rupture along its length from the second side edge to the first side edge.

Figure 5:
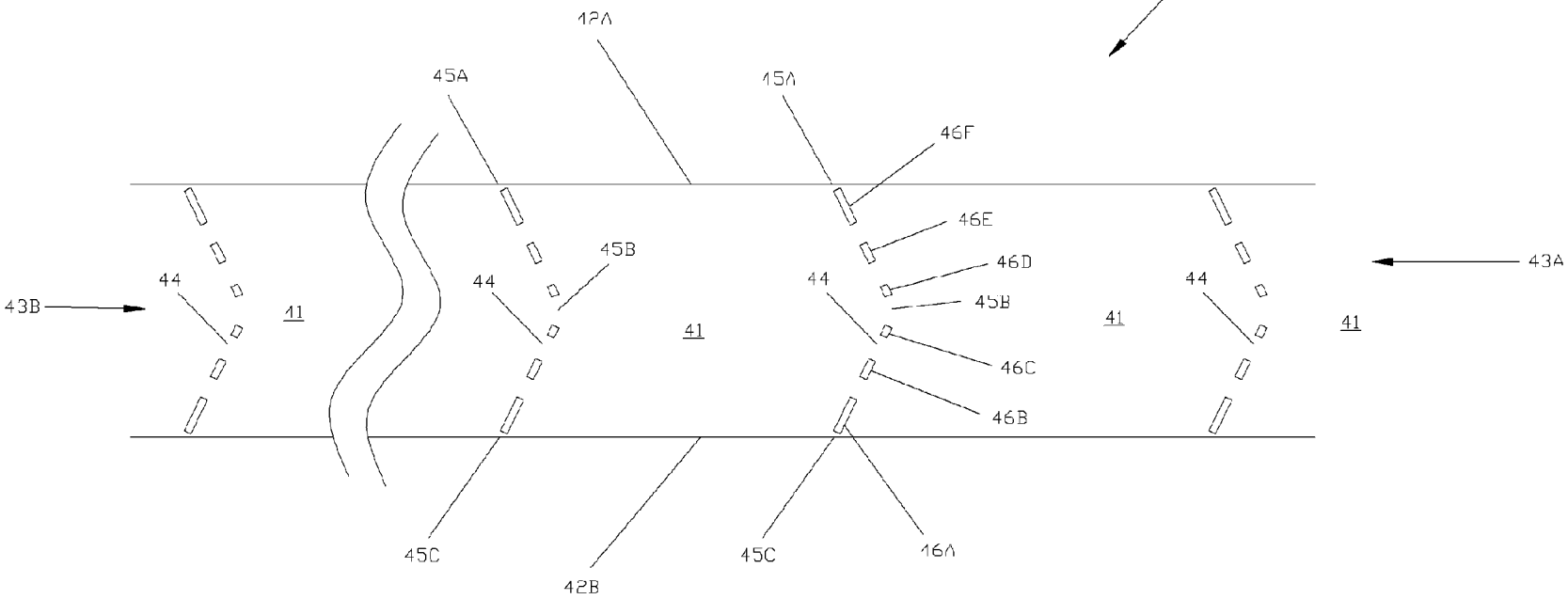
FIG. 5 shows a plan view of a fourth embodiment of wipes.

Referring now to FIG. 5 there are shown wipes 41 formed from a continuous length of material 42 with parallel first and second side edges 42A,42B having a leading end 43A and a trailing end 43B.

Ruputurable chevron lines 44 in material 2 are spaced along the length of material separating each wipe 41. Each rupturable line 44 extends from a point 45A on first side 42A edge to a point in the centre of a wipe 45B towards the leading end 43A, and then to a point 45C on the other second side edge 42B back towards the trailing end.

As shown, each line 44 is formed from slots 46A,46B,46C, 46D,46E,46F which vary in length so that slot 46A and 46F are both the longest, and slot 46C and 46D the shortest. Each line 44 is thus more easily ruptured adjacent the first side edge 42A and the second side edge 42C than at the centre 42B, and each line 44 is progressively more difficult to rupture along its length from the first and second side edges to the centre. In this instance, the rupturing process does not start until trailing edges 45A and 45C have reached the nozzle, leading edge 45B already being outside the container. Whilst the rupturing process is taking place, the ruptured areas of the wipe, having become separated from and now creating gaps with the main body of the material, will of necessity fall behind and further trail the non ruptured areas. So the angular nature of the rupturable chevron lines together with the delay between the rupture of the trailing edges 45A, 45C and that of the leading edge 45B ensures that when the first wipe has separated from the next second wipe, the leading edge of the next wipe to be withdrawn, 45B, extends fully out of the aperture so it can be gripped easily.

The wipes 1, 21, 31 or 41 may be formed of any suitable material, such as a non-woven fabric or paper, and may be impregnated as is well know in the art. The wipes may be wet or dry.

The invention may take a form different to that specifically described above. Instead of slots of varying length, uniform apertures could be provided which are greater in frequency adjacent the second side edge. Instead of the lines 4 being straight lines, they could be other shapes such as curved, wavy or any other non straight orientation.

Further modifications will be apparent to those skilled in the art without departing from the scope of the present invention.

The invention claimed is:

1. A container, comprising:

a nozzle or opening, and a roll of wipes formed from a continuous length of material with parallel side edges having a leading end and a trailing end, the container containing and dispensing the wipes in a direction parallel to the axis of the roll through the nozzle or opening of the container;

the wipes having rupturable lines spaced along the length of material separating each wipe, said rupturable lines extending from a point on one first side edge to a point on the other second side edge so that the wipes separated by the rupturable line are joined across the entire length of the rupturable line, and each rupturable line being progressively more difficult to rupture along its length from the second side edge to the first side edge;

the roll of wipes being arranged so that the harder to rupture point on the rupturable line emerges from the nozzle or opening before the rupturable line at the point on the first side edge, the nozzle or opening creating a resistive force that causes the rupturable line to rupture after the second side edge has emerged from the nozzle or opening.

2. A container according to claim 1 wherein the rupturable line is other than normal (perpendicular) to the first and second side edges.

3. A container according to claim 1, wherein the point on the other second side edge is further towards the trailing end.

4. A container according to claim 1, wherein the rupturable lines are formed from apertures or slots in the material.

5. A container according to claim 4, wherein slots are provided and the slots are longer adjacent the second side edge.

6. A container according to claim 4, wherein apertures are provided and the apertures are greater in frequency adjacent the second side edge.

7. A container according to claim 1, wherein the rupturable lines are straight lines.

8. A container according to claim 1, wherein the rupturable lines are curved, wavy or any other non-straight orientation.

9. Wipes formed in a continuous length for use in a container according to claim 1.

10. Wipes according to claim 9, wherein the rupturable lines are formed from apertures or slots in the material.

11. Wipes according to claim 9, wherein slots are provided and the slots are longer where it is easier to rupture each line.

12. Wipes according to claim 9, wherein apertures are provided and the apertures are greater in frequency where it is easier to rupture each line.

13. Wipes according to claim 9, wherein the rupturable lines are straight lines.

14. Wipes according to claim 9, wherein the rupturable lines are curved, wavy or any other non straight orientation.

15. Wipes according to claim 9, wherein the material is a non-woven fabric.

16. Wipes according to claim 9, wherein the material is impregnated.

17. Wipes according to claim 9, wherein the wipes are wet.

* * * * *